US008820282B2

(12) United States Patent
Busse et al.

(10) Patent No.: US 8,820,282 B2
(45) Date of Patent: Sep. 2, 2014

(54) PRESSURE ACCUMULATOR ARRANGEMENT FOR A CAMSHAFT ADJUSTING SYSTEM

(75) Inventors: Michael Busse, Herzogenaurach (DE); Mathias Boegershausen, Puschendorf (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 151 days.

(21) Appl. No.: 13/638,032

(22) PCT Filed: Apr. 4, 2011

(86) PCT No.: PCT/EP2011/055173

§ 371 (c)(1), (2), (4) Date: Sep. 28, 2012

(87) PCT Pub. No.: WO2011/134740

PCT Pub. Date: Nov. 3, 2011

(65) Prior Publication Data

US 2013/0008399 A1 Jan. 10, 2013

(30) Foreign Application Priority Data

Apr. 26, 2010 (DE) ..... 10 2010 018 203

(51) Int. Cl.
*F01L 1/344* (2006.01)

(52) U.S. Cl.
USPC ..... 123/90.17

(58) Field of Classification Search
USPC ..... 123/90.15, 90.17
See application file for complete search history.

(56) References Cited

U.S. PATENT DOCUMENTS

2003/0188704 A1* 10/2003 Aimone ..... 123/90.17

FOREIGN PATENT DOCUMENTS

| | | |
|---|---|---|
| DE | 3929621 | 3/1991 |
| DE | 4210580 | 10/1993 |
| DE | 10238354 | 1/2004 |
| DE | 102009024898 | 2/2010 |
| DE | 102009049459 | 4/2011 |
| JP | 2010014026 | 1/2010 |
| WO | 2008140897 | 11/2008 |

* cited by examiner

*Primary Examiner* — Thomas Denion
*Assistant Examiner* — Jorge Leon, Jr.
(74) *Attorney, Agent, or Firm* — Volpe and Koenig, P.C.

(57) ABSTRACT

A pressure accumulator arrangement in a camshaft for a camshaft adjusting system of an internal combustion engine, having at least one pressure accumulator and at least one control valve, characterized in that the pressure accumulator and control valve are connected to form a structural unit.

4 Claims, 1 Drawing Sheet

PRESSURE ACCUMULATOR ARRANGEMENT FOR A CAMSHAFT ADJUSTING SYSTEM

FIELD OF THE INVENTION

The invention relates to a pressure accumulator arrangement in a camshaft for a camshaft adjusting system of an internal combustion engine having at least one pressure accumulator and at least one control valve.

BACKGROUND

In modern internal combustion engines, camshaft adjusting systems are used for the variable adjustment of the control times of gas exchange valves, in order for it to be possible for the phase relation between the crankshaft and the camshaft to be designed in a defined angular range in a variable manner. Hydraulic camshaft adjusting systems usually require energy for the adjusting operation, which energy is made available to them via a pressure medium system. Here, the energy which is available in the pressure medium system is formed from the product of pressure medium pressure and pressure medium volumetric flow. During an adjustment of one or more camshafts of the internal combustion engine, the required pressure medium flow, which flows into the camshaft adjuster, is branched off by means of at least one control valve which is connected upstream of the camshaft adjuster. At the same time, an equally large pressure medium flow passes out of the camshaft adjuster back into the pressure medium reservoir of the pressure medium system, and is therefore fed to the pressure medium system again. As a result of the removal of the pressure medium flow out of the pressure medium system, the pressure medium pressure falls as a consequence. As a result, the energy is also reduced which is available to the camshaft adjuster for the adjustment. In order to prevent this, a pressure accumulator can be provided which makes pressure energy available to the camshaft adjusting system in the case of a drop in the pressure medium pressure, for equalization purposes.

A volume accumulator which communicates with a camshaft adjuster is described in a patent application which has already been filed by the applicant under the reference number DE 10 2009 049 459.6 but has not yet been published. The volume accumulator is formed in a cavity of a camshaft and is connected, via a pressure medium channel which is arranged in the camshaft, to a control valve which serves to supply the camshaft adjuster with pressure medium. In this embodiment, the circumstance has a disadvantageous effect that the control valve and volume accumulator are configured separately. As a result, said components have to be mounted individually, in each case on one side of the camshaft, and are connected to one another by way of a pressure medium channel in the camshaft. In addition, throttling losses can occur in the pressure medium channel, in particular because of cross-sectional constrictions, additional baffles or deflection means, as a result of which the function of the pressure accumulator is impaired.

SUMMARY

The invention is therefore based on the object of simplifying a pressure accumulator arrangement of the abovementioned type with regard to its construction and designing it to be inexpensive. The object is achieved by the features of the invention.

A pressure accumulator arrangement is provided, in which the pressure accumulator and control valve are connected to form one structural unit. As one structural unit, the pressure accumulator arrangement can be produced simply and can be mounted in the camshaft on one side in a simple way. A structural unit of this type at the same time improves the function of the pressure accumulator; as a result of the direct attachment of the pressure accumulator to the control valve, in particular, throttling losses can be avoided between said control valve and the pressure accumulator.

A structural unit comprising a pressure accumulator and control valve for arrangement in the camshaft can be achieved in a particularly simple way if the pressure accumulator and control valve are plugged into one another at end sections of their housings and form a press-fit connection. Other non-positive and/or positive and/or material-to-material connections of the housings are also conceivable.

It is advantageous if the control valve and pressure accumulator are configured with a reduced diameter at their housing end sections which are plugged into one another. In this way, a radial annular gap is produced in a cavity of the camshaft with respect to the inner wall of the camshaft, in the mounted state of the structural unit. Here, the pressure medium supply of the structural unit can take place directly at the housing end sections. To this end, a plurality of radially aligned openings are preferably provided on the housing end sections in the region of the annular gap, which openings communicate via the annular gap with a pressure medium inflow connection on the camshaft.

The housing end section of the control valve is preferably plugged axially into the end section of the housing of the pressure accumulator and is of extended configuration such that it at the same time forms, at its front-side end, an end stop in the housing of the pressure accumulator for a piston which can be displaced axially in said housing.

BRIEF DESCRIPTION OF THE DRAWINGS

Further features of the invention result from the following description and from the drawings, in which one exemplary embodiment of the invention is shown in simplified form and in which.

DETAILED DESCRIPTION OF THE PREFERRED EMBODIMENTS

Figure 1:
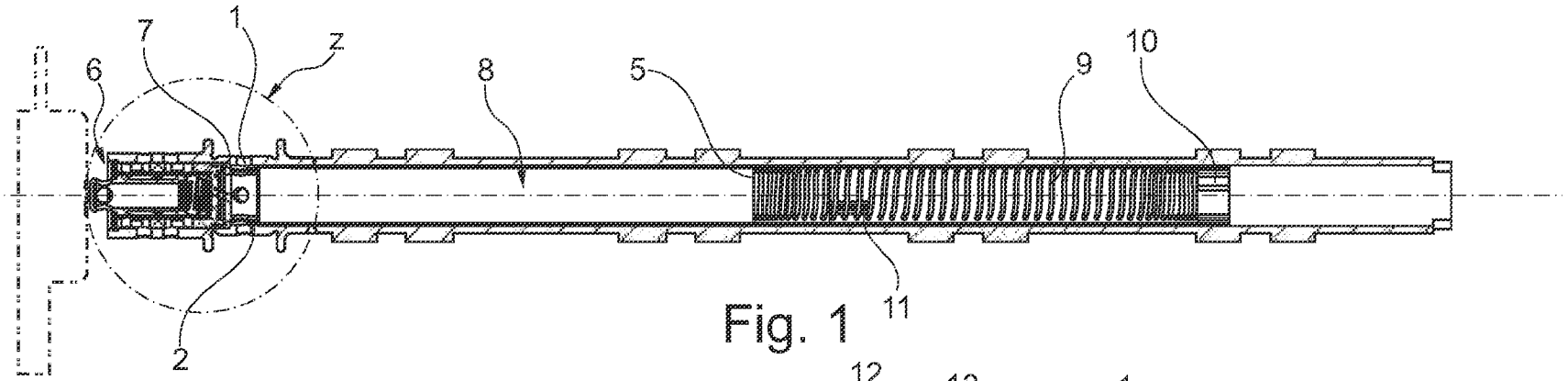
FIG. 1 shows a longitudinal section of a pressure accumulator arrangement according to the invention in a camshaft.

FIG. 1 shows one exemplary embodiment of a pressure accumulator arrangement according to the invention for a hydraulic camshaft adjusting system (not shown) of an internal combustion engine. The pressure accumulator arrangement is arranged in a camshaft of the internal combustion engine and includes a pressure accumulator and a control valve which are configured as one structural unit. The camshaft is axially open on both sides, for example is configured as a hollow shaft. In its interior, the camshaft has a cylindrical cavity for accommodating the structural unit, which cavity is configured in each case as an axial central bore in two sections with different diameters. At that end region of the camshaft which faces the camshaft adjusting system, the control valve which is configured as a central valve is arranged in a first section of the cavity. The control valve is connected upstream of the camshaft adjusting system and is formed of a central valve assembly 6 which has a substantially cylindrical housing. At an annular step 7, the first section of the cavity is adjoined by a second section which is configured with a slightly reduced diameter compared to the former and in which the pressure accumulator is arranged which is formed by a pressure accumulator assembly 8. The latter comprises a substantially hollow-cylindrical housing, a piston 5 and a compression spring 9. In the interior of the housing, the piston 5 separates a pressure space, which faces the control valve axially and is in pressure medium connection via the latter with the camshaft adjusting system, from a pressureless complementary space, in which the compression spring 9 is accommodated. The piston 5 is of cup-shaped configuration, is arranged such that it can be displaced axially in the housing, and is guided on the inner wall of the latter. Both the housing and the piston 5 can be configured in sheet metal and can be produced without the removal of material, in particular by deep drawing.

The control valve and pressure accumulator are arranged coaxially in the camshaft and are connected at their housings to form one structural unit. To this end, the hollow-cylindrical end sections 1, 2, which face one another axially, of their housings are plugged into one another and form a press-fit connection. Other non-positive and/or positive and/or material-to-material connections are also conceivable, such as screw connections, adhesive bonds or flange connections. In this way, the control valve and pressure accumulator form a pressure accumulator/central valve structural unit which can be pushed simply into the cavity as one component for installing at that open end of the camshaft which faces the camshaft adjusting system.

In the housing of the pressure accumulator, the piston 5 is loaded, on its closed axial side which faces the pressure space, with pressure medium via the end section 2 and is operatively connected at the same time, on its axial side which faces away from the pressure space, to the compression spring 9 which is configured as a helical compression spring. If the pressure medium pressure rises in the camshaft adjusting system, pressure medium flows via the end sections 1, 2 which are plugged into one another into the pressure space and displaces the piston 5 axially in the housing of the pressure accumulator counter to the spring force of the helical compression spring. If the pressure medium pressure falls, the compressed helical compression spring expands and in the process makes the stored spring energy and the pressure medium which is stored in the pressure space available to the camshaft adjusting system. Here, the control valve and pressure accumulator are in direct pressure medium connection at their hollow-cylindrical end sections 1, 2, which are plugged into one another, of their housings.

The pressure medium leakage at the piston 5 in the housing of the pressure accumulator can be discharged, at that open end of the camshaft which faces away from the camshaft adjusting system, via an outflow connection to a pressure medium reservoir, for example the engine oil reservoir of the internal combustion engine, and at the same time the housing can be ventilated and bled on the spring side.

The helical compression spring is arranged coaxially in the housing of the pressure accumulator and engages with its spring end section which faces the piston 5 into its open end on the spring side. Here, the spring end section bears on the inside against the closed axial side of the piston 5. At the spring end section which faces away from the piston 5, the helical compression spring is supported axially on a spring support 10 which is integrated into the housing. During a movement of the piston 5, the helical compression spring is guided on the inner wall of the housing and on the inner wall of the piston 5. In order to limit the movement of the piston 5 in the stressed state of the helical compression spring, an axial stop 11 is provided which is integrated into the housing. FIG. 1 shows the piston 5 in the position on the stop 11 with stressed helical compression spring.

Figure 2:
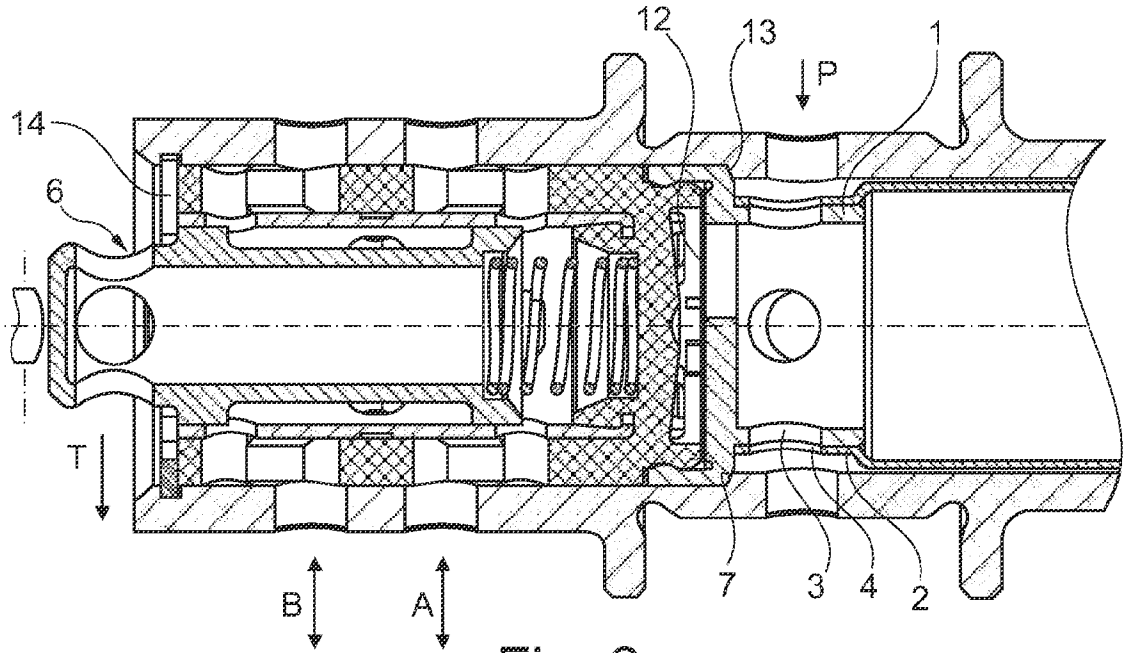
FIG. 2 shows an enlarged illustration of the detail Z from FIG. 1.

FIG. 2 shows the pressure accumulator arrangement in an enlarged portion (detail Z from FIG. 1) at that end region of the camshaft which faces the camshaft adjusting system. The central valve assembly 6 is accommodated in the first section of the cavity. This central valve assembly 6 comprises the housing, an intermediate sleeve, a control piston which is accommodated in the latter, and a plate nonreturn valve 12 which is integrated into the control valve. The control valve communicates with the camshaft adjusting system via working connections A, B. The control piston which is arranged axially movably in the housing can be actuated via a central magnet which is indicated diagrammatically by dashed lines. An outflow connection T is configured at that end section of the control piston which faces the open end of the camshaft, via which outflow connection T pressure medium can flow out of the camshaft adjusting system into a pressure medium reservoir (not shown).

The plate nonreturn valve 12 serves to prevent backflow in the direction of the pressure medium inflow connection P and is integrated into that end region of the control valve which faces the pressure accumulator in a separately configured housing part. The latter is configured on the outer side of the housing of the control valve such that it can be plugged in an annular radial groove in a positively locking manner, and is configured such that it is lengthened axially on its side which faces the pressure accumulator by the hollow-cylindrical end section 1 which is recessed by way of a reduced diameter. For connection to the control valve, that hollow-cylindrical end section 2 of the housing of the pressure accumulator which faces said control valve is reduced in diameter and is pressed axially onto the end section 1 in a press fit. Here, the end section 1 is configured so as to be lengthened axially in such a way that, at its front-side end in the housing of the pressure accumulator, approximately at the level of the shoulder on the housing, which shoulder is formed by the reduced end section 2, it forms an end stop for the piston 5 in the relieved state of the helical compression spring.

At the housing end sections 1, 2 which are recessed in each case with a reduced diameter on the housings, a radial gap with respect to the inner wall of the camshaft is produced in the cavity of the camshaft. The pressure medium inflow connection P is provided on the camshaft in the region of the annular gap, which pressure medium inflow connection P is connected to a pressure medium pump via a pressure medium system (not shown), for example the engine oil circuit of the internal combustion engine. The pressure medium inflow connection P has a plurality of radial through holes on the camshaft, which through holes are distributed over the circumference. These through holes correspond radially on the inside via the annular gap with a plurality of openings 3, 4 which are arranged and distributed over the circumference in each case at those end sections 1, 2 of the housings which are plugged into one another, for supplying pressure medium to the structural unit, which openings 3, 4 are configured as radial through holes. The openings 3 at the end section 1 and the openings 4 at the end section 2 are arranged in each case so as to be aligned radially.

On the housing of the control valve, the end section 1 which is recessed with a reduced diameter forms an annular shoulder 13 which, in the mounted state on the annular step 7, bears against the inner wall of the camshaft in the cavity. For mounting, the control valve and the pressure accumulator can be pushed in, as one structural and mounting unit, at that end of the camshaft which faces the camshaft adjusting system, until the annular shoulder 13 comes into contact with the annular step 7. As a result, in the mounted state on the annular step 7, the structural unit is at the same time secured axially in the camshaft on the pressure accumulator side. On the valve side, the axial positional securing of the structural unit takes place by means of a securing ring 14 which is arranged in an annular groove on the inner wall in the first cavity of the camshaft, on that side of the housing which faces axially away from the pressure accumulator. Here, the housing bears axially against the securing ring 14 on the end side.

In the first cavity of the camshaft, the housing of the control valve and the inner wall of the camshaft form a cylindrical clearance fit. In this way, the control valve and the pressure accumulator can be centered as one structural unit in the camshaft on the housing of the control valve. Here, the housing of the pressure accumulator is arranged in the second section of the cavity, with a radial annular gap with respect to the inner wall of the camshaft. As a result, manufacturing tolerances can be compensated for at the outer diameter of the housing of the pressure accumulator and/or the requirements made on the manufacturing tolerances of the second section of the cavity in the camshaft can be set at a lower level. Here, in order to guide the housing in the cavity, said housing and the inner wall of the camshaft can form a clearance fit in sections. To this end a slight housing widening can be provided, for example, at that end region of the housing which faces away from the control valve.

LIST OF DESIGNATIONS

1 End section
2 End section
3 Opening
4 Opening
5 Piston
6 Central valve assembly
7 Annular step
8 Pressure accumulator assembly
9 Compression spring
10 Spring support
11 Stop
12 Plate nonreturn valve
13 Annular shoulder
14 Securing ring
A Working connection
B Working connection
P Pressure medium inflow connection

The invention claimed is:

1. A pressure accumulator arrangement in a camshaft for a camshaft adjusting system of an internal combustion engine, comprising at least one pressure accumulator and at least one control valve, the pressure accumulator and the control valve are connected to form one structural unit arranged in the camshaft.

2. The pressure accumulator arrangement as claimed in claim 1, wherein the pressure accumulator and the control valve each have a housing, and the housings are plugged into one another at end sections thereof with a press-fit connection.

3. The pressure accumulator arrangement as claimed in claim 2, wherein the control valve and the pressure accumulator are configured in each case with a reduced diameter at the end sections, which are plugged into one another, of the respective housings, and the end sections in each case have a plurality of radially aligned openings which are distributed on a circumference, for pressure medium supply to the structural unit.

4. The pressure accumulator arrangement as claimed in claim 2, wherein the end section of the housing of the control valve is plugged axially into the end section of the housing of the pressure accumulator and is of extended configuration such that a front-side end of the housing end section of the control valve forms an end stop for a piston which is axially displaceable in the housing of the pressure accumulator.

* * * * *